US008413626B2

(12) United States Patent
MacVicar

(10) Patent No.: US 8,413,626 B2
(45) Date of Patent: Apr. 9, 2013

(54) LASH ADJUSTER

(75) Inventor: Robert T. MacVicar, Downers Grove, IL (US)

(73) Assignee: Electro-motive Diesel, Inc., LaGrange, IL (US)

( * ) Notice: Subject to any disclaimer, the term of this patent is extended or adjusted under 35 U.S.C. 154(b) by 403 days.

(21) Appl. No.: 12/366,894

(22) Filed: Feb. 6, 2009

(65) Prior Publication Data

US 2009/0199802 A1 Aug. 13, 2009

Related U.S. Application Data

(60) Provisional application No. 61/027,178, filed on Feb. 8, 2008.

(51) Int. Cl.
*F01L 1/14* (2006.01)

(52) U.S. Cl. ..... 123/90.52; 123/90.53; 123/90.59

(58) Field of Classification Search ..... 123/90.52, 123/90.53, 90.48, 90.59
See application file for complete search history.

(56) References Cited

U.S. PATENT DOCUMENTS

| | | | | |
|---|---|---|---|---|
| 2,887,996 | A | | 5/1959 | Wood |
| 3,406,668 | A | * | 10/1968 | Donnelly et al. ..... 123/90.56 |
| 3,716,036 | A | | 2/1973 | Kruger |
| 4,677,723 | A | | 7/1987 | Greene, Sr. |
| 4,735,197 | A | | 4/1988 | Ishida et al. |
| 4,815,424 | A | | 3/1989 | Buuck et al. |

FOREIGN PATENT DOCUMENTS

| | | |
|---|---|---|
| DE | 4225012 | 7/1993 |
| JP | 6193411 | 7/1994 |

* cited by examiner

*Primary Examiner* — Zelalem Eshete
(74) *Attorney, Agent, or Firm* — Finnegan, Henderson, Farabow, Garrett & Dunner LLP

(57) ABSTRACT

The present invention relates to a lash adjuster including a ball retainer having a generally conical chamber for situating a ball near the base of the lash adjuster housing. The chamber has both an external and internal shoulder for engaging a plunger spring and a ball spring, respectively. The chamber may further define at least one aperture near its apex and at least one aperture near its base to facilitate oil flow through the lash adjuster.

11 Claims, 9 Drawing Sheets

LASH ADJUSTER

CROSS-REFERENCE TO RELATED APPLICATIONS

The present patent application is a non-provisional application claiming the benefit under 35 U.S.C. §119(e) of U.S. Provisional Application Ser. No. 61/027,178, filed on Feb. 8, 2008 and entitled "LASH ADJUSTER," naming Robert MacVicar as inventor, the complete disclosure thereof being incorporated herein by reference.

BACKGROUND OF THE INVENTION

The present invention generally relates to a lash adjuster for use in an intake or exhaust valve system. Specifically, the present invention is directed to a ball retainer for a lash adjuster which promotes strength and facilitates oil flow through the lash adjuster.

It is known in the art relating to internal combustion engines, such as diesel engines, and namely locomotive diesel engines, to actuate two adjacent valves of an engine cylinder by rotating a cam. As shown in FIG. 1A, the cam 104 generally includes a select shape which determines the timing of valves 106*a, b* actuation. In order to open the valves 106*a, b* the cam 104 rotates until the cam lobe 108 engages a roller 110 located on a rocker arm 112. The rocker arm 112, in turn, engages a valve bridge 114, which causes tension in adjacent springs 116*a, b* causing the valves 106*a, b* to open.

Generally, valve systems are subject to thermal expansion as the engine heats up. Accordingly, if the valve stems 120*a, b* thermally expand and elongate, the valves 106*a, b* are unable to fully close. Because the components of the valve system are exposed to a range of temperatures throughout the cycle, there must be a means of self-adjusting the length of the valve stems 120*a, b*. Lash adjusters provide such adjustability so that there is zero clearance at all times between the valve bridge 114 and the valve stems 120*a, b* so that the valves operate—even when thermal expansion occurs. The lash adjuster may further adjust for wear or other deflections in the engine to provide zero clearance between the valve bridge 114 and the valve stems 120*a, b*.

One type of lash adjuster is a hydraulic lash adjuster. An example of a prior art hydraulic lash adjuster including a pressure actuated check valve is shown in FIG. 1A, and more specifically in FIG. 1B. This prior art valve system generally incorporates two hydraulic lash adjusters 102*a, b*, which are received in sockets 122*a, b* near opposite ends of the valve bridge 114 to engage the ends of the valve stems 120*a, b*. The lash adjuster sockets 122*a, b* are generally formed at the outer, distal ends of the cross-arm portion of the valve bridge 114, and lash adjusters 102*a, b* have traditionally been press-fit within each of these sockets 122*a, b*.

During operation, when the valves 106*a, b* begin to open, a force is applied across the lash adjusters 102*a, b*. As shown in FIG. 1B, with respect to lash adjuster 102*a*, the force from valve 106*a* causes a small volume of oil to flow through an aperture 124 in the ball retainer 126. A small volume of oil flows through the clearance 128 between the ball 130 and the ball retainer 126 and out the aperture 124. Because the clearance 128 between the ball 130 and the ball retainer 126 is small, oil cannot flow past the ball 130 fast enough to prevent pressure building up within the cavity 132 of the lash adjuster 102*a*. When this pressure becomes greater than the supply pressure within the valve bridge 114, the ball 130 is forced upward until it contacts the ball seat 134 in the housing of the lash adjuster 102*a* and seals the aperture 124. When the valve 106*a* is open, a force is maintained across the lash adjuster 102*a*, maintaining the internal pressure, situating the ball 130 against the ball seat 134, and preventing oil from flowing out of the aperture 124, A similar lash adjuster arrangement is generally provided for lash adjuster 102*b*, which engages valve 106*b*. However, these prior art lash adjuster 102*a, b* arrangements are slow-acting. Accordingly, it is an aspect of the present invention to be fast-acting and facilitate oil flow through the system.

Referring to FIGS. 2A-C, in order to overcome the slow-acting nature of the system as shown in FIGS. 1A and 1B, a stamped metal ball retainer 226 had been created. In this prior art valve system, when the engine's valves 206*a, b* are closed, the lash adjusters 202*a, b* are in their normally closed position. More specifically, as shown with respect to lash adjuster 202*a* in FIG. 2B (corresponding to valve 206*a* in FIG. 2A), in this normally closed position, the ball 230 is held against a ball seat 234 machined in the lash adjuster housing 236 by a ball spring 238. While the valve 206*a* is open, a force is maintained across the lash adjuster 202*a* which maintains the internal pressure and, acting with the ball spring 238, situates the ball 230 against the ball seat 234 preventing oil from flowing out of aperture 224. During this time, a small volume of oil is forced out of the cavity 232 through the very small clearance 240 between the plunger 242 and the housing 236. When the valve 206*a* is returned to its seat, the force across the lash adjuster 202*a* is relaxed and the pressure in the cavity 232 drops. When the pressure becomes less than the supply pressure by an amount proportional to the force of the ball spring 238, the ball 230 separates from the ball seat 234 slightly and allows oil to flow past the ball seat 234 and into the cavity 232 via apertures 242*a, b, c*, defined in the ball retainer 226 (shown in FIG. 2D). At the same time, the valve bridge 214 is held against the rocker arm 212 under the influence of the large valve bridge spring; this allows the plunger 242 to move upward under the influence of the plunger spring 244 causing the cavity pressure to drop below the outside pressure and allowing oil flow into the cavity 232 until the pressure equalizes. A similar lash adjuster arrangement is generally provided for lash adjuster 218*b* which engages valve 206*b*.

Nevertheless, the stamped metal ball retainer of FIGS. 2A-D includes a generally thin sidewall. For example, the thickness of the sidewall of the stamped metal ball retainer is generally about 0.014 inches. As such, a high stress area 248 is present where the base of the ball retainer 226 engages the base of the housing 236 (as shown in FIG. 2B). Accordingly, it is an aspect of the present invention to strengthen the ball retainer to avoid having vulnerable high stress areas.

These and other desired benefits of the preferred embodiments, including combinations of features thereof, of the invention will become apparent from the following description. It will be understood, however, that a process or arrangement could still appropriate the claimed invention without accomplishing each and every one of these desired benefits, including those gleaned from the following description. The appended claims, not these desired benefits, define the subject matter of the invention. Any and all benefits are derived from the multiple embodiments of the invention, not necessarily the invention in general.

SUMMARY OF THE INVENTION

This invention relates to a lash adjuster, and specifically a machined ball retainer. The lash adjuster is comprised of a housing having an aperture defined therein. The housing generally houses a plunger and a ball retainer. The ball retainer has a generally conical shaped chamber for situating a ball near the base of the housing. The ball retainer's chamber has both external and internal shoulders. The external shoulder is located near the apex of the chamber and is used to engage the plunger via a plunger spring. The internal shoulder is located in the chamber and near the aperture formed in the base of the housing and is used to engage a ball spring, which situates a ball within the chamber. The chamber has at least one aperture near its base and an additional aperture formed near its apex.

The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiments shown, but is to be accorded the widest scope consistent with the principles and features described herein.

DETAILED DESCRIPTION

The present invention generally relates to a lash adjuster for use in an exhaust valve system. Specifically, the present invention is directed to a ball retainer which promotes strength and facilitates oil flow through the lash adjuster.

Figure 1A:
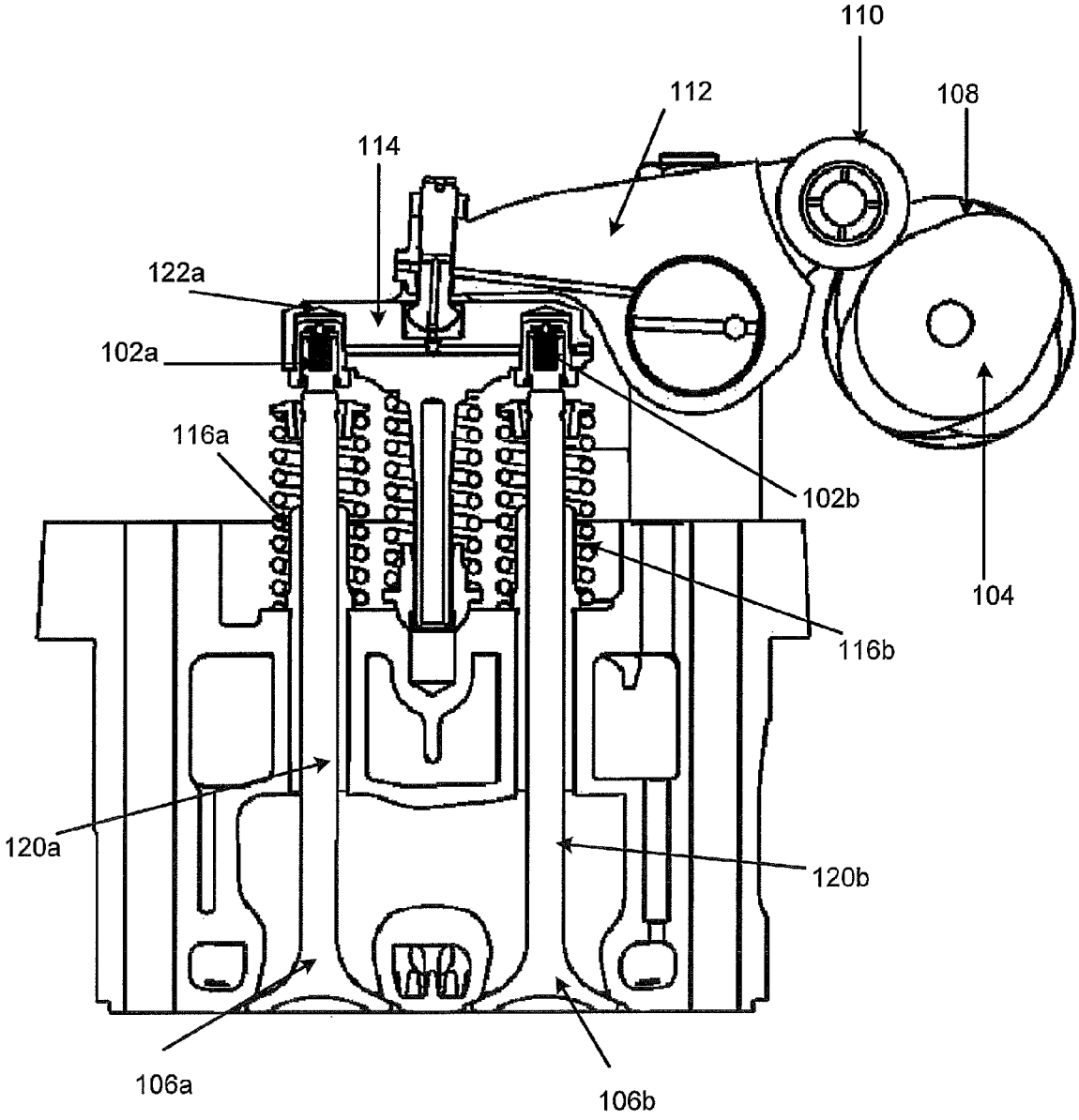
Figure 1A (Prior Art)
FIG. 1A is a cross-sectional view of a prior art valve train system having a hydraulic lash adjuster.
Figure 1B:
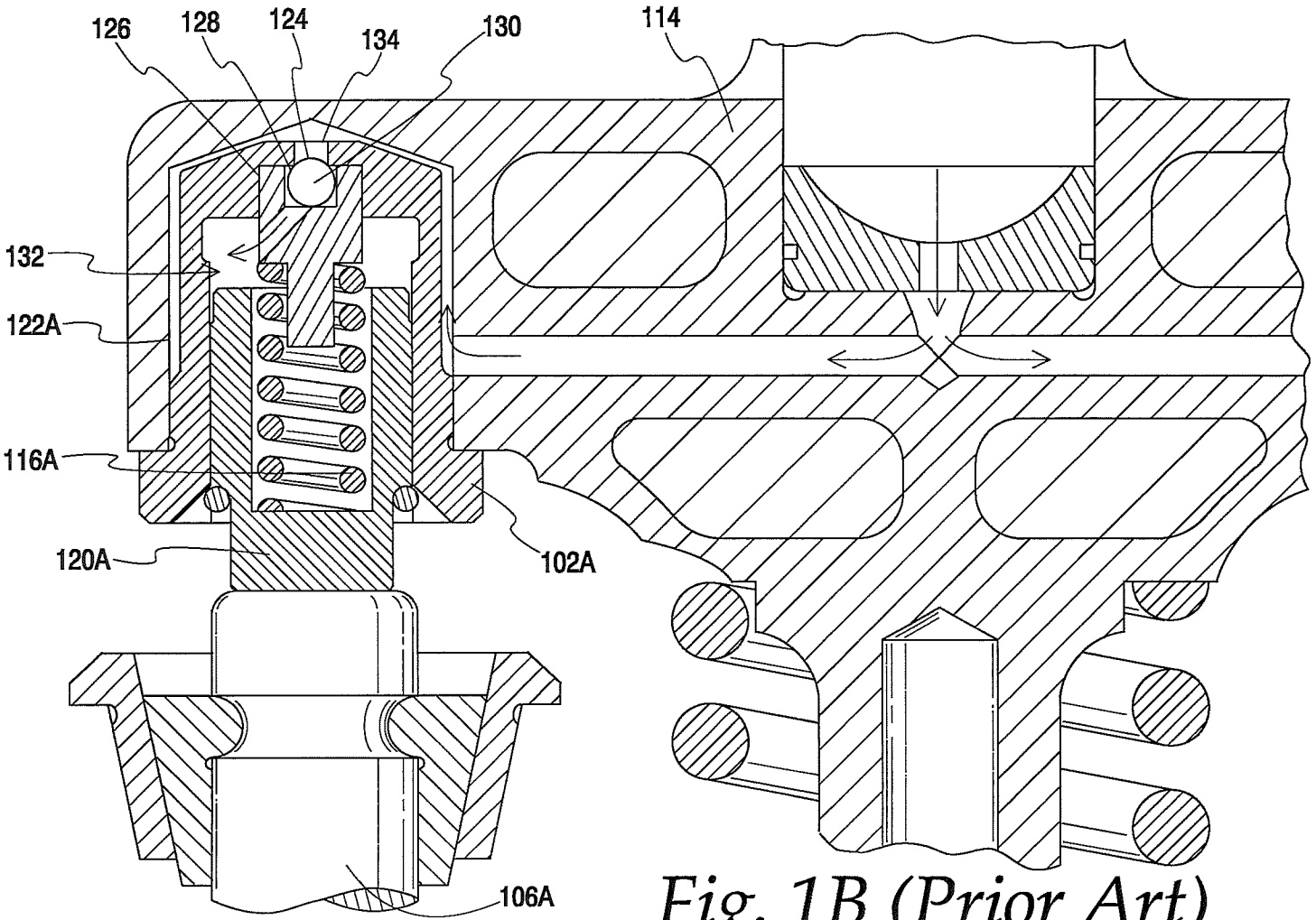
Fig. 1B (Prior Art)
FIG. 1B is another cross-sectional view of the prior art valve bridge assembly of the valve train system of FIG. 1A.
Figure 2A:
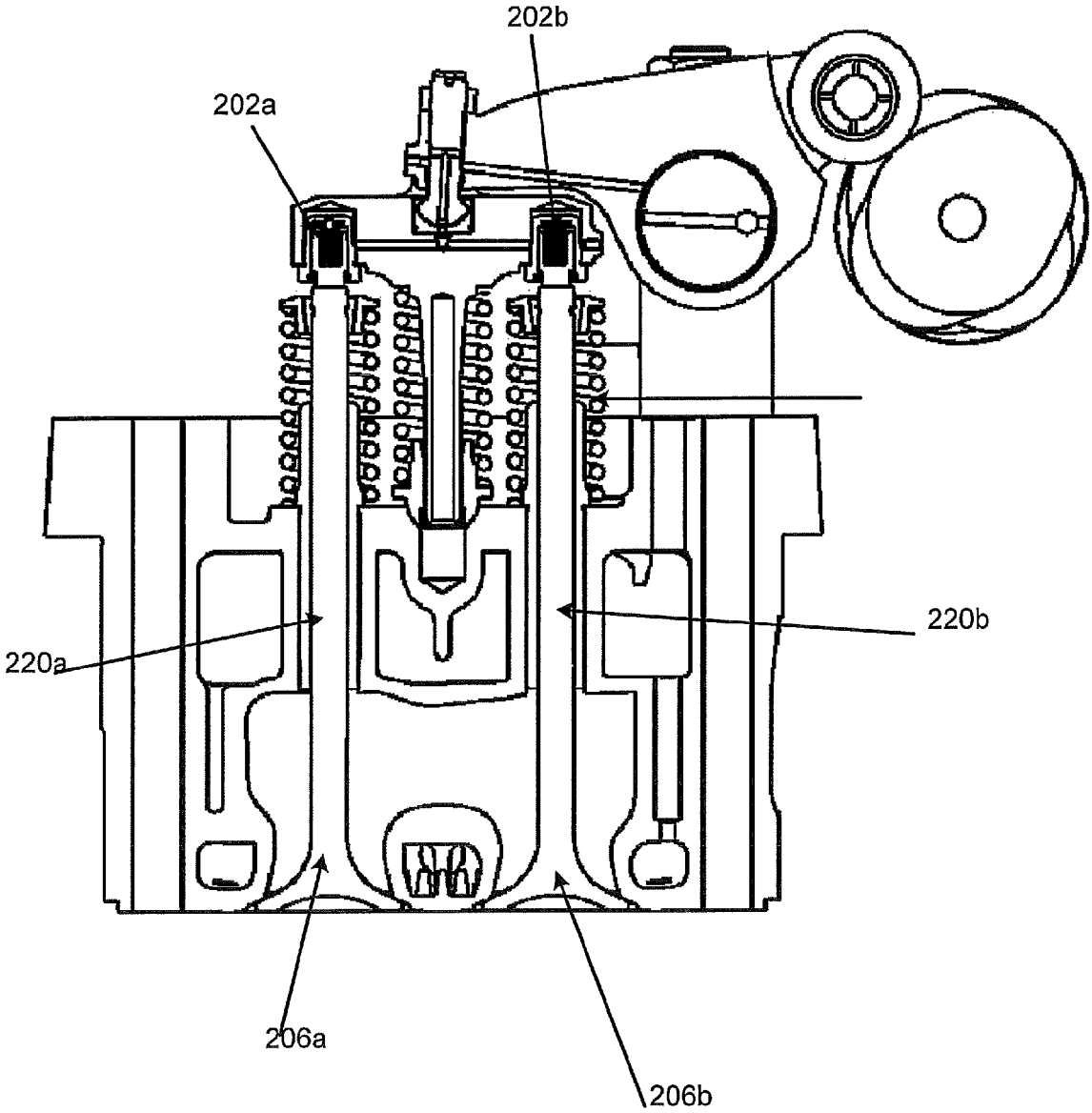
Figure 2A (Prior Art)
FIG. 2A is a cross sectional view of another prior art valve system including a lash adjuster having a stamped metal ball retainer.
Figure 2B:
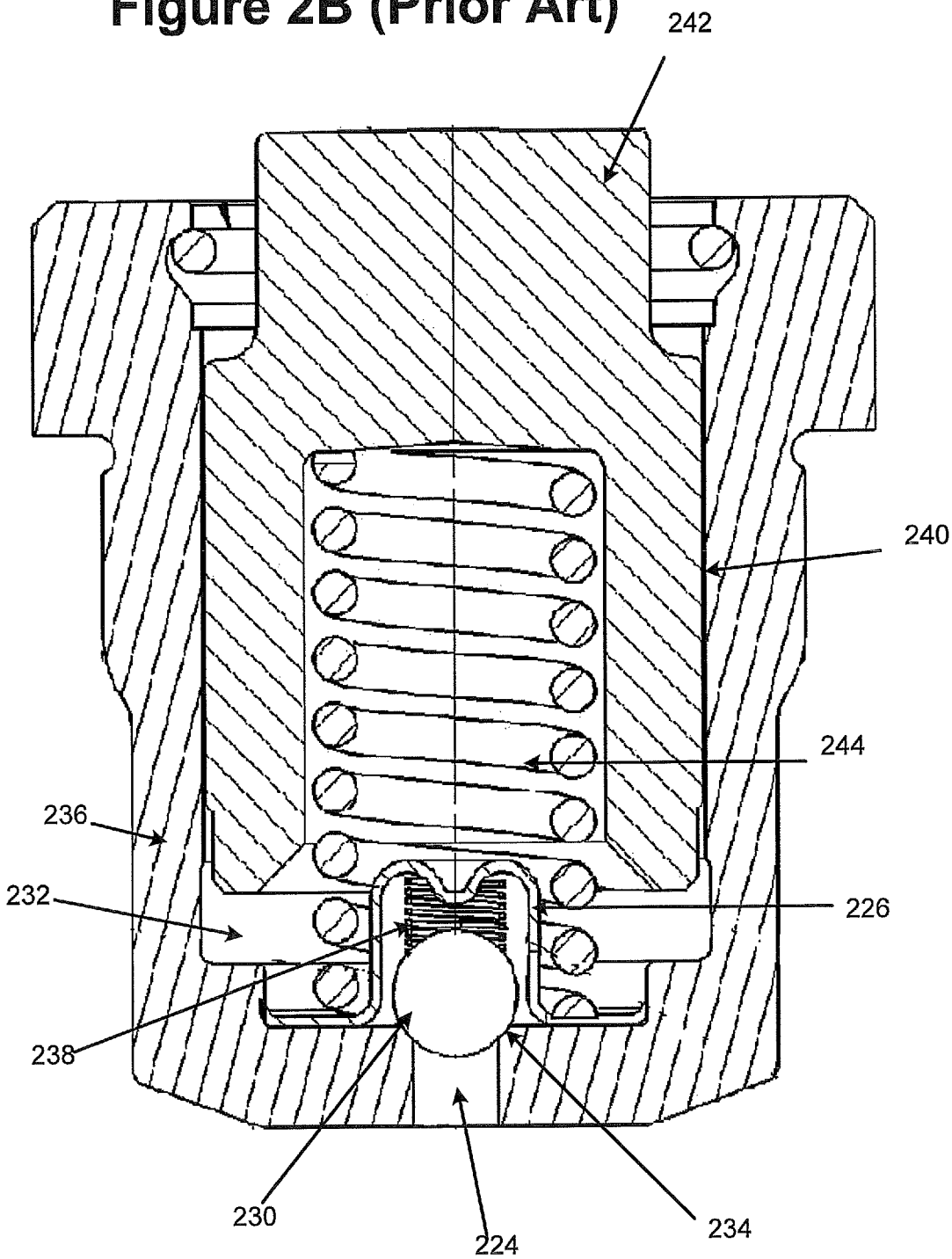
Figure 2B (Prior Art)
FIG. 2B is a cross-sectional view of the lash adjuster of FIG. 2A having a stamped metal ball retainer.
Figure 2C:
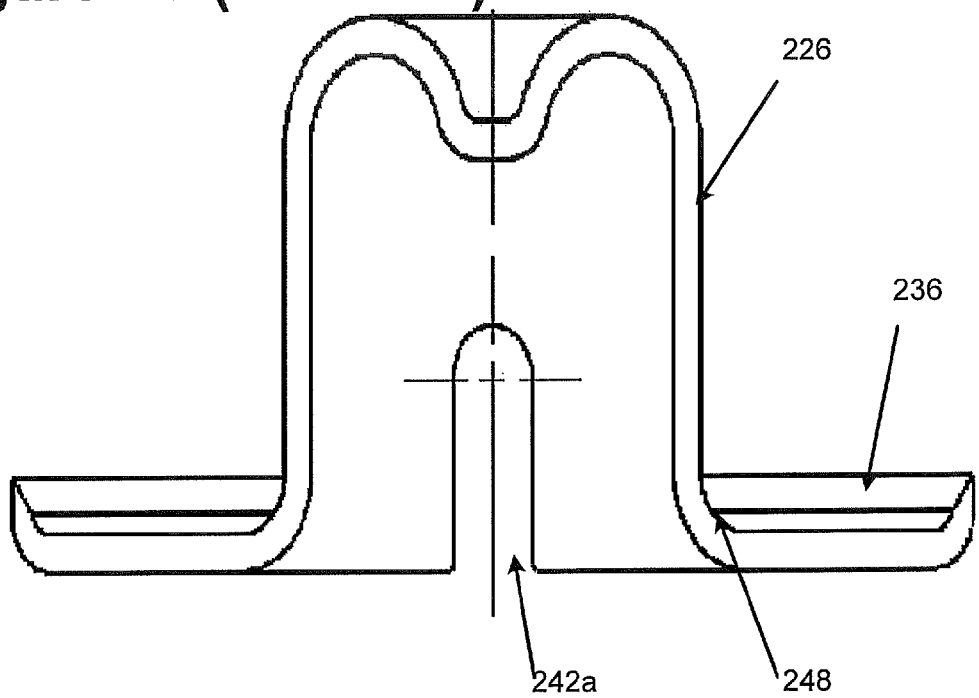
Figure 2C (Prior Art)
FIG. 2C is cross-sectional view of the stamped metal ball retainer for the lash adjuster of FIG. 2B.
Figure 2D:
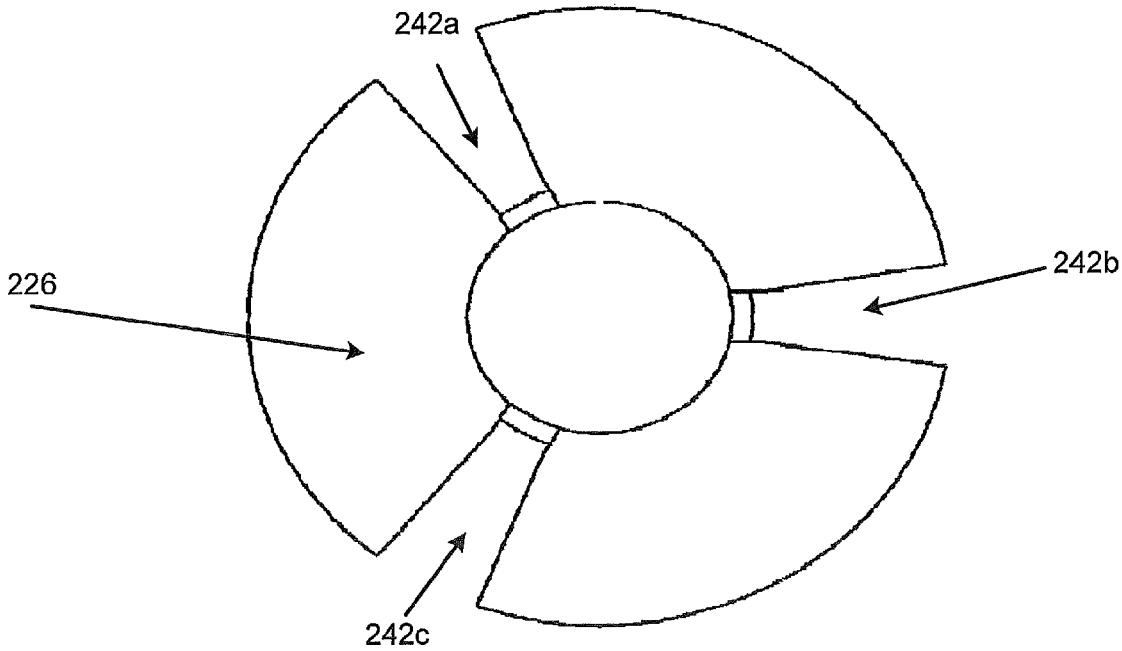
Figure 2D (Prior Art)
FIG. 2D is a top view of the ball retainer of FIG. 2C.

FIGS. 3A-D illustrate present invention lash adjusters 302*a, b* including ball retainers which may replace the stamped metal ball retainers 226*a, b* of FIGS. 2A-C. More specifically, in FIG. 3B, the new lash adjuster 302 is comprised of a housing 336 having at least one aperture 324 in its base. A plunger 342 is positioned within the housing 336. Within the lash adjuster 302 is a ball retainer 326 with a generally conical shaped chamber 351 for retaining a ball 330 near the base of the housing 336. The wall of the ball retainer 326 has a thickness of about 0.050 to about 0.080 inches, and preferably about 0.068 inches. In accordance with one aspect of the present invention, the ball retainer may be machined from solid steel, but the ball retainer may also be molded, stamped, etc. and may also be comprised of other suitable materials other than steel.

Figure 3A:
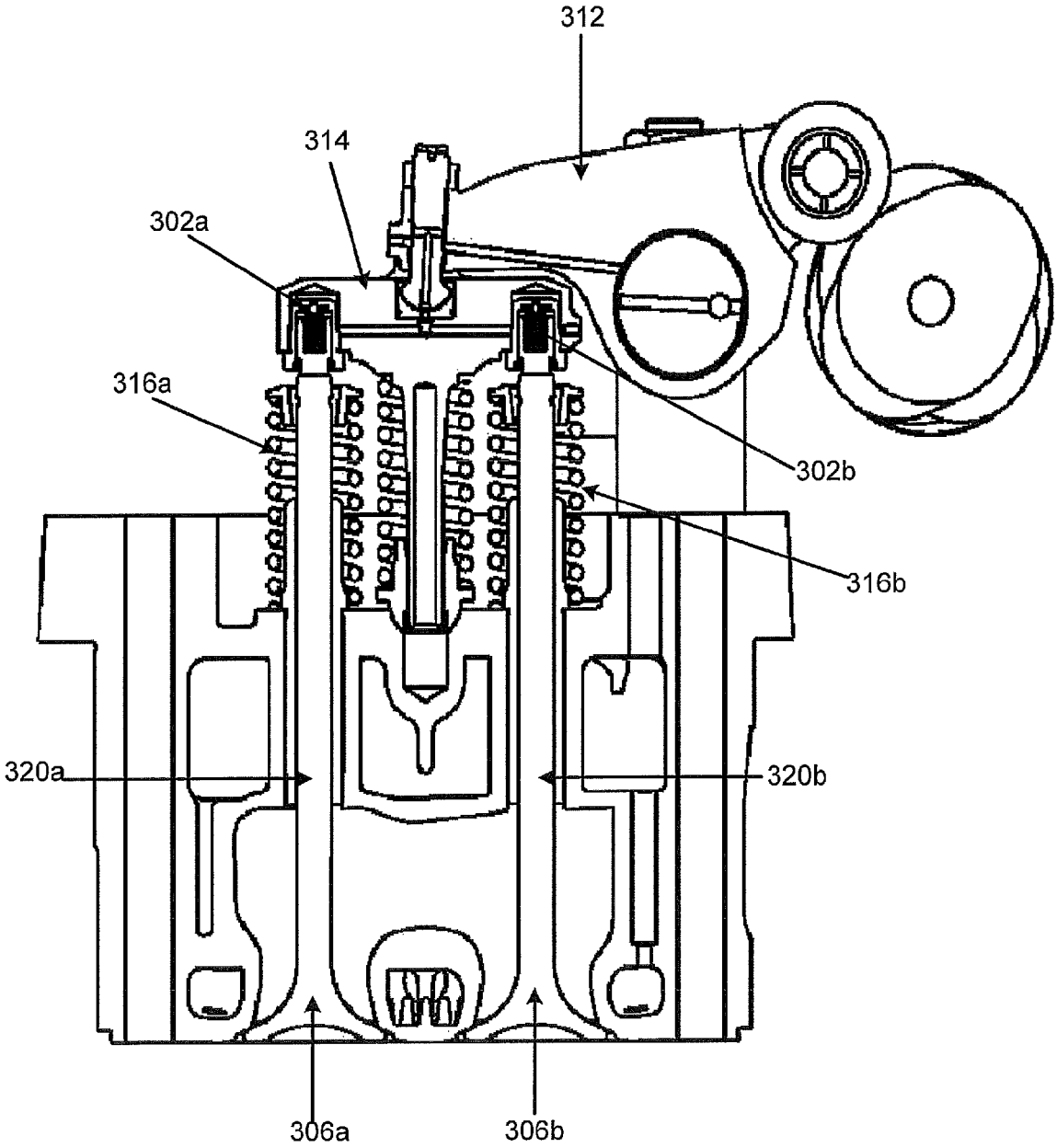
FIG. 3A is a cross-sectional view of a valve train system including the present invention lash adjuster.
Figure 3B:
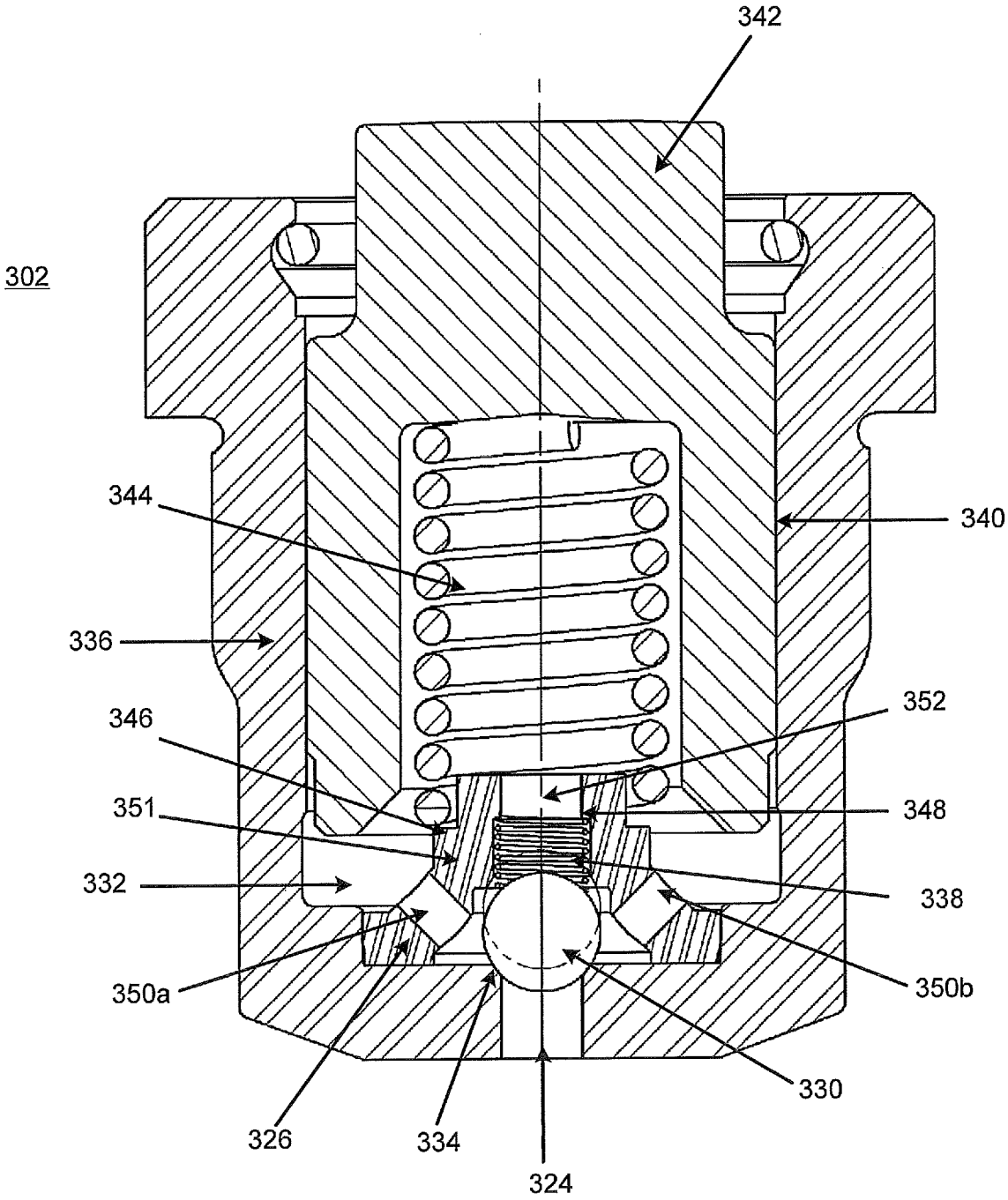
FIG. 3B is a cross-sectional view of the present invention lash adjuster of FIG. 3A.
Figure 3D:
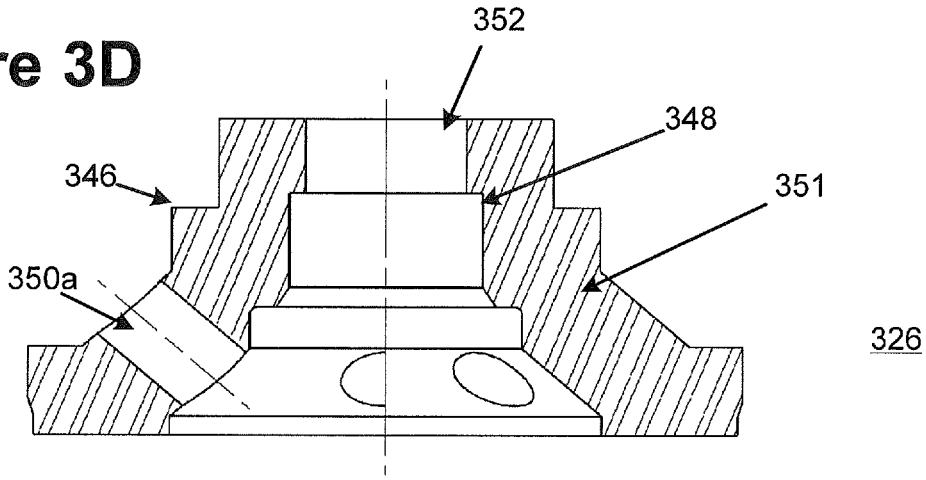
FIG. 3D is a cross-sectional view of the present invention ball retainer of FIG. 3C, taken at A-A.
Figure 3C:
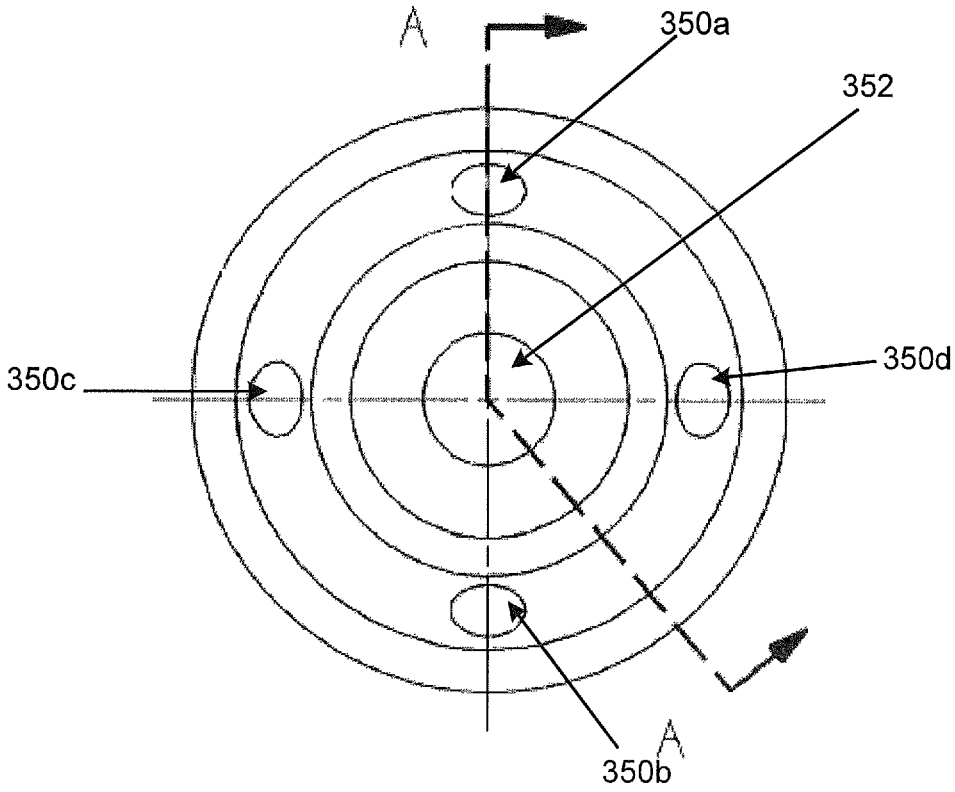
FIG. 3C is a top view of the present invention ball retainer of FIG. 3B.

As shown specifically in FIGS. 3B and 3D, the chamber 351 of the ball retainer 326 includes an external shoulder 346 near its apex for engaging the plunger 342 via a plunger spring 344. The chamber 351 also includes an internal shoulder 348 for engaging a ball spring 338 that situates the ball 330 within the chamber 351, near the aperture 324 formed in the base of the housing 336 of the lash adjuster 302. The external and internal shoulders 346, 348 promote strength in the ball retainer 326. The chamber 351 further includes at least one aperture 350*a, b* near its base and at least one aperture 352 near its apex in order to facilitate oil flow through the lash adjuster 302*a*.

Now referring back to FIGS. 3A and 3B, during operation, when the engine's valves 306*a, b* are closed, lash adjusters 302*a, b* are in their normally closed position. More specifically, as shown with respect to lash adjuster 302*a* and valve 306*a*, the ball 330 is held against a ball seat 334 defined in the base of the housing 336 by a ball spring 338, thereby sealing the aperture 324 in the base of the housing 336. While the valve 306*a* is open, a force is maintained across lash adjuster 302*a* which, in turn, maintains the internal pressure and, acting with the ball spring 338, situates the ball 330 against the ball seat 334 preventing oil from flowing out the aperture 324 defined near the base of the housing 336.

During this time, a small volume of oil is forced out of the cavity 332 through the very small clearance 340 between the plunger 342 and the housing 336. When the valve 306*a* is returned to its scat, the force across the lash adjuster 302*a* is relaxed and the pressure in the cavity 332 drops. When the pressure becomes less than the supply pressure by an amount proportional to the force from ball spring 338, the ball 330 separates from the ball seat 334 slightly and allows oil to flow past the ball seat 334 and into the cavity 332. At the same time, the valve bridge 314 is held against the rocker arm 312 under the influence of the large valve bridge spring 316*a*; this allows the plunger 342 to move downward under the influence of the plunger spring 344 causing the cavity 332 pressure to drop below the outside pressure and allowing oil flow into the cavity 332 until the pressure equalizes. A similar lash adjuster arrangement may be generally provided for lash adjuster 302*b* which engages valve 306*b*.

As a result, the present invention lash adjuster arrangement corrects problems faced in the prior art by promoting strength, facilitating oil flow, and providing lenience for thermal expansion.

The above description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiments shown, but is to be accorded the widest scope consistent with the principles and features described herein.

Figure 4:
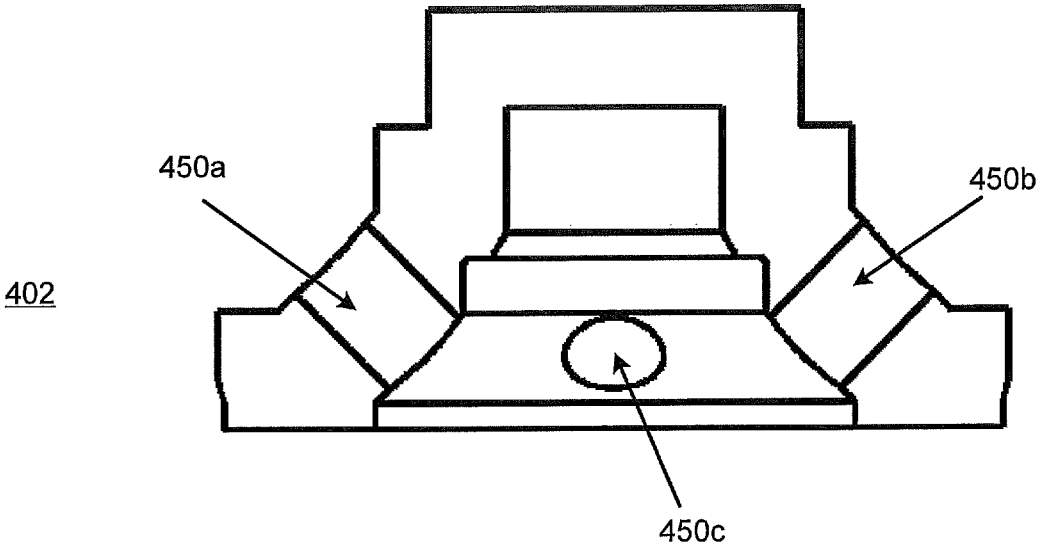
FIG. 4 is a cross-sectional view of another embodiment of the ball retainer in accordance with another aspect of the present invention.
Figure 5:
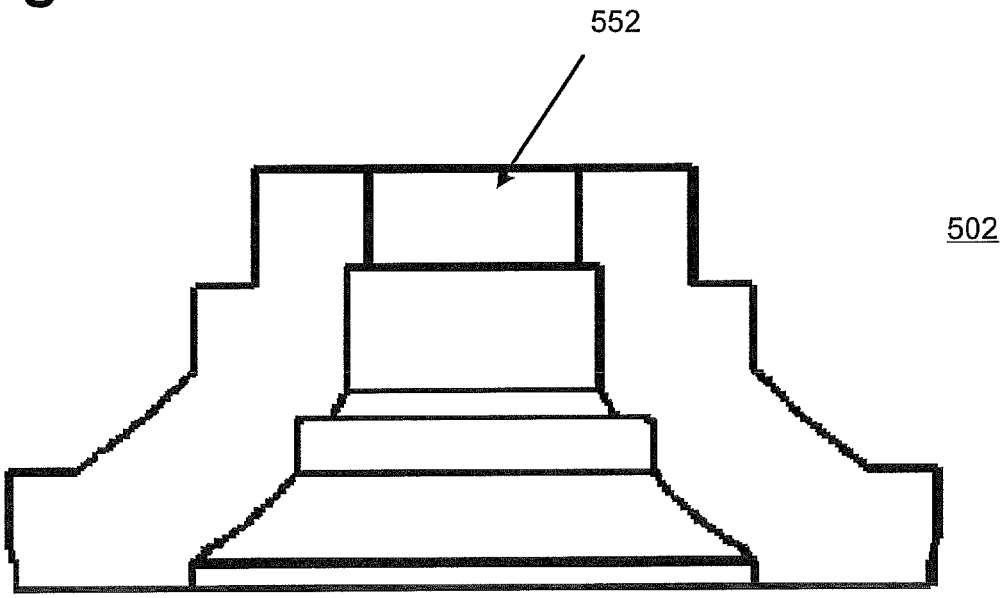
FIG. 5 is a cross-sectional view of yet another embodiment of the ball retainer in accordance with another aspect of the present invention.

Variations of the present invention lash adjuster can be made whilst retaining its efficiency. For instance, in FIG. 3C four apertures 350 *a, b, c, d* are shown to be defined near the base of the ball retainer 326 chamber 351. These apertures may be of any shape or size and in any location. In accordance with another embodiment, FIG. 4 shows another ball retainer 426 wherein there is no aperture defined near its apex. Instead, apertures 450 *a, b, c* are shown to be defined near the base of the ball retainer 426 chamber 351. In yet another embodiment, shown in FIG. 5, the ball retainer 526 defines no apertures near its base. Instead, there is an aperture 552 defined near its apex.

The present invention has been described in accordance with the embodiments shown, and one of ordinary skill in the art will readily recognize that there could be variations to the embodiments, and any variations would be within the spirit and scope of the present invention. Accordingly, many modifications may be made by one of ordinary skill in the art without departing from the spirit and scope of the appended claims.

The invention claimed is:

1. A lash adjuster, comprising:

a housing having a base which defines an aperture therein, a plunger situated within said housing, a ball retainer having a generally conical chamber for retaining a ball near the base of the housing, the chamber of said ball retainer having an external shoulder near its apex for engaging said plunger via a plunger spring, wherein the external shoulder is defined by an annular ledge, and including an internal shoulder for engaging a ball spring which situates the ball within the chamber and near the aperture formed in the base of said housing, and said chamber further defining at least one aperture near its base and an additional aperture formed near its apex, wherein the external shoulder is closer to the apex of the chamber than the at least one aperture near the base of the chamber, wherein the housing and the ball retainer at least partially define an annular cavity disposed between the housing and the ball retainer, and wherein the at least one aperture provides oil flow between the aperture formed in the base of said housing and the annular cavity.

2. The lash adjuster of claim 1, wherein the housing further comprises a seat about the aperture such that when the ball engages the aperture, a seal is created therebetween.

3. The lash adjuster of claim 1 wherein the ball retainer is composed of machined metal.

4. The lash adjuster of claim 1 wherein the chamber of said housing further comprises a cavity holding oil.

5. A lash adjuster comprising:

a housing having a base which defines an aperture therein, a plunger situated within said housing, and a generally conical ball retainer situated near the base of the housing, said ball retainer having an external shoulder near its apex for engaging said plunger via a plunger spring, wherein the external shoulder is defined by an annular ledge, and further including an aperture defined near its base, wherein the external shoulder is closer to the apex of the ball retainer than the aperture near the base of the ball retainer, wherein the housing and the ball retainer at least partially define an annular cavity disposed between the housing and the ball retainer, and wherein the aperture provides oil flow between the aperture defined in the base of said housing and the annular cavity.

6. The lash adjuster of claim 5, wherein the housing further comprises a seat about the aperture such that when the ball engages the aperture, a seal is created therebetween.

7. The lash adjuster of claim 5 wherein the ball retainer is composed of machined metal.

8. The lash adjuster of claim 5 wherein the chamber of said housing further comprises a cavity holding oil.

9. The lash adjuster of claim 5, wherein no apertures are defined near the apex of the ball retainer.

10. A ball retainer for use in a lash adjuster including a housing having a base which forms an aperture therein and a plunger situated within said housing, said ball retainer comprising:

a generally conical chamber for retaining a ball near the aperture defined in the base of the lash adjuster, the chamber further including at least one aperture near its base, a shoulder externally situated near the apex of the chamber for engaging said plunger via a plunger spring, wherein the externally situated shoulder is defined by an annular ledge, and a shoulder internally engaging a ball spring for situating said ball near the aperture defined in the base of said housing, wherein the externally situated shoulder is closer to the apex of the chamber than the base of the housing when the ball retainer is in use with the lash adjuster, wherein the housing and the chamber at least partially define an annular cavity disposed between the housing and the chamber, and wherein the at least one aperture provides oil flow between the aperture formed in the base of said housing and the annular cavity.

11. A lash adjuster, comprising:

a housing defining a cavity for holding oil therein, said housing having a base which defines an aperture therein and having an internal sidewall for engaging a plunger, the plunger situated within said housing and having an external sidewall for engaging, a ball retainer having a generally conical chamber for retaining a ball near the base of the housing, the chamber of said ball retainer having an external shoulder near its apex for activating said plunger via a plunger spring, wherein the external shoulder is defined by an annular ledge, and including an internal shoulder for engaging a ball spring which situates the ball within the chamber and near the aperture formed in the base of said housing, and wherein when said plunger is engaged, the ball is situated such that it seals the aperture in the housing to prohibit oil flow therefrom but allows oil to flow from the housing via the engagement between the plunger and the housing and wherein when said plunger is disengaged, the ball is situated such that the aperture is opened to allow oil flow therethrough, said chamber further defining at least one aperture near its base to facilitate oil flow therethrough and an additional aperture formed near its apex to facilitate oil flow therethrough, and the external shoulder is closer to the apex of the chamber than the at least one aperture near the base of the chamber, wherein the cavity is disposed between the housing and the ball retainer, and wherein the at least one aperture provides oil flow between the aperture formed in the base of said housing and the annular cavity.

* * * * *